United States Patent [19]

Urai

[11] Patent Number: 4,761,035

[45] Date of Patent: Aug. 2, 1988

[54] SEAT CUSHION ASSEMBLY

[75] Inventor: Muneharu Urai, Tokyo, Japan

[73] Assignee: Tachikawa Spring Co., Ltd., Tokyo, Japan

[21] Appl. No.: 72,528

[22] Filed: Jul. 13, 1987

Related U.S. Application Data

[63] Continuation-in-part of Ser. No. 813,004, Dec. 24, 1985, abandoned.

[51] Int. Cl.[4] ..... A47C 7/14; A47C 7/18

[52] U.S. Cl. ..... 297/452; 297/224; 297/DIG. 1

[58] Field of Search ..... 5/481; 297/224, 452, 297/DIG. 1

[56] References Cited

U.S. PATENT DOCUMENTS

| | | | |
|---|---|---|---|
| 3,117,819 | 1/1964 | Kudriavetz | 297/452 |
| 4,232,898 | 11/1980 | Bodrero | 297/224 |
| 4,665,606 | 5/1987 | Saito et al. | 297/DIG. 1 |

FOREIGN PATENT DOCUMENTS

| | | | |
|---|---|---|---|
| 1600732 | 10/1981 | United Kingdom | 297/DIG. 1 |

*Primary Examiner*—Alexander Grosz

*Attorney, Agent, or Firm*—Oldham, Oldham & Weber Co.

[57] ABSTRACT

An automobile seat cushion back including a contoured seat cushion with a trim cover thereon and a stretchable support layer for such seat cushion. A soft back cover is secured to and extends between opposed edges of said support layer to form an open ended bag therewith. Such bag can be pulled over a seat cushion back to be secured thereto under tension.

9 Claims, 1 Drawing Sheet

FIG.-1
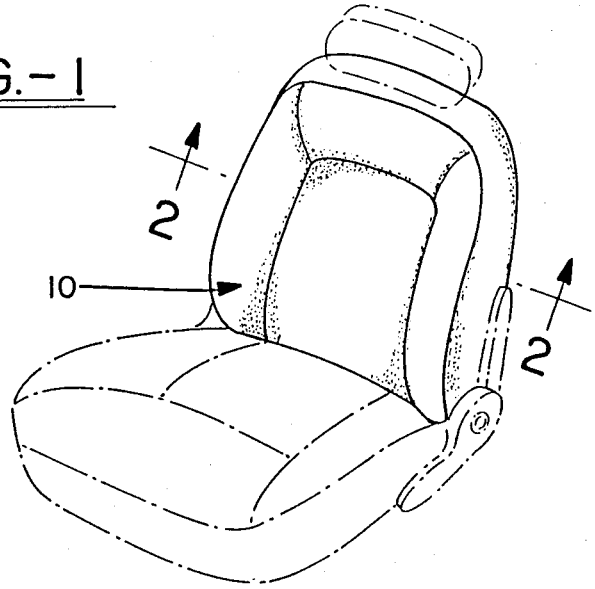
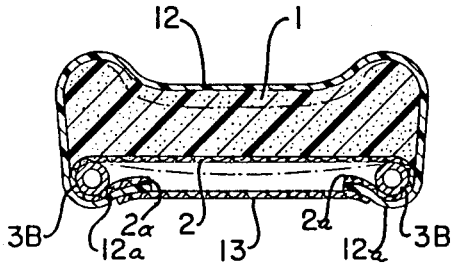
FIG.-2
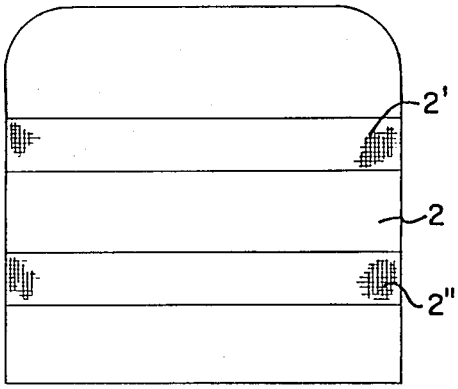
FIG.-3
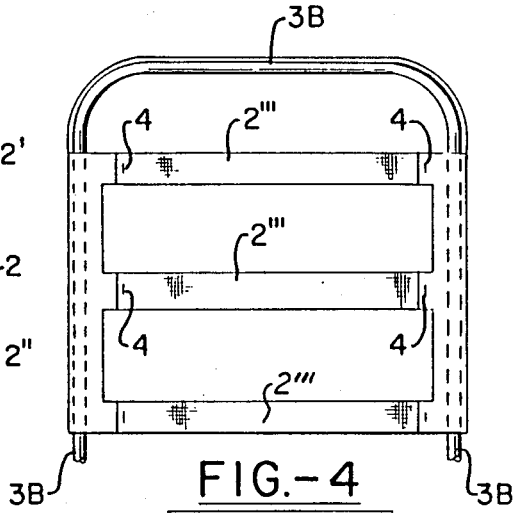
FIG.-4

SEAT CUSHION ASSEMBLY

This is a continuation-in-part of prior application Ser. No. 813,004, filed Dec. 24, 1985, now abandoned.

TECHNICAL FIELD

This invention relates to seat cushions and especially to automotive seat cushion assemblies.

BACKGROUND OF THE INVENTION

This invention relates to a seat cushion assembly which is simplified in its structure, has a light weight and can be manufactured at a low cost.

In most conventional seats, a plurality of zigzag springs of steel are mounted in parallel to each other on a seat frame, and a cushion member of a synthetic resin such as a pad of polyurethane foam is placed on the springs to deal with or support the load of a person sitting on the seat.

In such a conventional seat of double structure including a plurality of springs and a cushion member, its weight and cost have already been reduced almost to their limits.

BRIEF SUMMARY OF THE INVENTION

With a view to overcome the limits of the weight and cost of the conventional seat, it is a primary object of the present invention to provide a novel seat cushion assembly in which, without the use of the springs of steel employed in the conventional seat, the tensile strength of a cushion member of, for example, polyurethane foam is utilized together with the conventional manner of utilization of its resiliency against compression, and a support member is combined with the cushion member so as to replace the function of the conventional springs by the combination of the support member and the cushion member of polyurethane foam, thereby achieving simplification of the seat construction, reduction of the seat weight and, remarkably, reduction of the manufacturing cost.

This invention has for its object to provide a seat back assembly for automobiles, which comprises frame members, a resilient contoured cushion member having front, side and back surfaces, said cushion member being positioned in front of said frame members, a trim cover covering the front and sides of said cushion member and being partly turned around said frame members, a back cover of substantially no stretchability operatively secured to the edges of said trim cover providing a soft back covering to the seat back assembly, a stretchable tensioned support member located between said cushion member and said back cover, said support member and said back cover forming a shape of a bag and being mounted onto said frame members in a condition that the bag is stretched to slide onto said frame members.

BRIEF DESCRIPTION OF DRAWINGS

Preferred embodiments of the present invention will now be described in detail with reference to the accompanying drawings, in which:

FIG. 1 is a perspective view of an automobile seat forming an embodiment of the present invention;

FIG. 2 is a schematic sectional view taken along the line 2—2 in FIG. 1, for showing a structure of an embodiment of a seat back according to the present invention;

FIG. 3 is a schematic front view of a modification of a seat back, for showing reinforcing support bands;

FIG. 4 is a schematic back view of another modification of a seat back, for showing reinforcing backing support portions.

BEST MODE FOR CARRYING OUT THE INVENTION

Referring now to FIG. 1, which is a perspective view of a front seat for an automobile, this invention relates to and is applied to a seat back of the front seat. FIG. 2 is a sectional view taken along the line 2—2 in FIG. 1 and shows a section of the seat back which is a preferred embodiment of this invention, and is indicated as a whole by the numeral 10.

The upper and lower parts of FIG. 2 correspond to the front and back respectively of the seat cushion. As is clear in this figure, an extension of a trim cover 12 covering the cushion member 1 and an extension of a support member 2 are fixed to a back cover 13 after being partly trained around a tubular frame member 3B. In detail, the cushion member 1 is a contoured polyurethane foam. The support member 2, which is a stretchable fabric, is combined with the cushion member 1. Such a combination is provided by wholly or partly bonding the support member 2 to the lower surface of the cushion member 1 or integrally molding or securing the support member 2 to the cushion member 1 during the step of formation of the polyurethane foam cushion. The trim cover 12 is combined with the upper surface of the cushion member 1 also by bonding or by an integral molding method. As shown in the FIG. 2, the portions or edge portions **12*a* of the trim cover 12 and the extensions or edges 2*a* of the support member 2 are combined with each other and the edge portions of a back cover 13 by means of, for example, sewing. This sewing is also made at the top of the seat back, although such details are not shown in the figure. Thus, the assembly forms the shape of a bag which is open at its bottom. Strictly speaking, the bag is formed by the support member 2 and the back cover 13. The back cover 13** is made of a strong non-stretchable fabric.

The support member 2 is in the form of a fabric or the like. Stretchable threads such as those formed of synthetic fibers of polyurethane called by the trade name of "Spandex" or those obtained by covering cores of rubber with filaments of cotton or synthetic resin or those obtained by shaping synthetic fibers into a spiral or zigzag form to possess resiliency like that of a spring utilizing the thermoplasticity of such fibers can be used to make the support member 2. As another example, the support member 2 may be in the form of a knitted fabric or the like which is rendered stretchable depending on the mode of fabrication or may be in the form of a fabric of rubber, or a fabric including rubber filaments as a component.

The width of the abovementioned bag is such that when it is stretched and pulled over the tubular pipe frames 3B and 3B, the stretchable support member 2 is enlarged and desired tensile forces are introduced. Substantial assembly procedure is finished by covering the bag over the pipe frame.

Dotted lines in FIG. 2 show the seat cushion assembly when a load is imparted to its cushion member 1, as when a person rests his back against the assembly or sits thereon. FIG. 2 illustrates that both cushion member 1 and the support member 2 are deformed and deflected downward or backwards. As soon as the load is removed, both the cushion member 1 and the support member 2 are restored to their original state shown by solid lines in FIG. 2. This is because the support member 2 and cushion member 1 combined in the manner above described are simultaneously subjected to a compressive force and a tensile force when a load is imparted; and, since the deformation of the cushion member 1 and support member 2 due to the tensile force is within its elastic limit, the cushion member 1 and support member 2 are restored to their original state upon release of the load pressure. Thus, the support member 2 exhibits the functional effect which is the same as that of, for example, conventional springs.

The support member 2 is not stretched beyond a predetermined limit when subjected to a load, and, therefore, the cushion member 1 is also extended within the stretchable limit of the support member 2 (i.e., within the elastic limit of the polyurethane foam against the tensile force).

The cushion member 1 is imparted with a tensile force at the entire area in contact with the mating area of the support member 2, and at the same time, subjected to the downward or backward compressive force imparted by the load. Therefore, the cushion member 1, subjected to the compressive force at its upper part, exhibits the same functional effect as that of a conventional cushion member.

The load-deflection curve of the seat cushion assembly in the state shown in FIG. 2 differs from the conventional one of the cushion member 1 of polyurethane foam only or that of the support member 2 only and is a synthesis of the load-deflection curve of the cushion member 1 and that of thed support member 2. This synthesized load-deflection curve is equivalent to or an improvement of that of the conventional springs of steel depending on the combination of the material and shape of the cushion member 1 and support member 2.

In the case of the conventional front seat in which the support member 2 according to the present invention is not used and the back cover 13 of a soft material is used, an occupant of the rear seat will have a feeling of hardness and physical disorder when his knees make contact with zigzag springs embedded in the front seat. In the case of the front seat shown in FIG. 1, on the other hand, the support member 2 formed of a soft material combined with the back cover 13 formed also of a soft material provides a feeling of softness to the knees of the occupant of the rear seat and this is also desirable from the aspect of safety.

Although not illustrated in FIG. 1, the portion of the support member 2 engaged by the lumbar region of a human body can be made stronger than the remaining portions.

FIG. 3 shows a modification wherein reinforcing stretchable support strips 2′ and 2″ are arranged over the support member 2 for partially changing the stretchability of the support assembly. For example, the lower section of the support member 2 is made to be stronger than the upper section so as to support the lumbar region of the human body. Thus, the tensile strength can be partly changed to deal with the distribution of the load, and saving in cost of the material of the support member 2 can be achieved. Although two reinforcing support sections are illustrated in FIG. 3, the upper 2″ strip may be omitted or the strips may be split into more sections, and these sections may be arranged in parallel, star or any other suitable pattern. Such strip 2′ can be secured to the support member 2 as by sewing or it can be suitably secured around the frames 3B and physically extend along the member 2 to resist deflection backwardly.

FIG. 4 shows another reinforcing means for the support member 2. This figure, like FIG. 3, is a back view of a seat back, with back cover removed. In this modification, strip portions 2‴ extended from the ends of, and may be integral with, the stretchable support layer or member 2 to form the shape of loops that extend around the pipe frame 3B. The front side of the support member 2 and the strip portions 2‴ are combined, when separate strips are used, at points 4 for example, by clips. This arrangement also contributes to the partial reinforcement of the tensile forces of the support member 2. In a further modification, not shown in the drawings, loop-shaped stretchable reinforcing support strips can be used in lieu of the abovementioned support strip 2′ or strip portion or 2‴, and it could be positioned on the frame 3B.

While in accordance with the patent statues, a preferred embodiment and best mode has been presented, the scope of the invention is not limited thereto, but rather is measured by the scope of the attached claims.

What is claimed is:

1. A seat back assembly for automobiles comprising:
a pair of spaced vertically directed frame members,
a resilient contoured cushion member having front, side and back surfaces, said cushions member being positioned in front of said frame members,
a trim cover covering the front and sides of said cushion member and extending partly turned around said frame members,
a back cover of substantially no stretchability secured to the edges of said trim cover providing a soft back covering to the seat back assembly, and
a stretchable, tensioned support member located between said cushion member and said back cover, said support member and said back cover being associated to form a bag which is mounted onto said frame members under tension.

2. A seat back assembly as claimed in claim 1, wherein a stretchable support strip is partially arranged on said support member for partially reinforcing the tensile strength of said support member.

3. A seat back assembly as claimed in claim 1, wherein said stretchable support member has extension portions which partially extend around said frame members over the full length of the back surface of said seat back, said extension portions having strips extending therefrom to form loops in such support members that engage said frame means for partially increasing said support member's tensile strength.

4. A seat back assembly as claimed in claim 3, wherein the front side of said stretchable support member and the backing extension portions thereof are an integral member.

5. A seat back assembly as claimed in claim 1, wherein said support member has edge portions partly turned around said tubular frame members, said edge portions being secured to said back cover.

6. A cushion assembly as claimed in claim 1, wherein said stretchable support member (2) has extension portions for partially extending around said frame members (3B) over the full length of the back surface of a seat back and wherein the front side of said stretchable support member and the backing extension portions thereof are integral.

7. A cushion assembly for seat back assembly for automobiles having frame members (3B) and comprising a resilient contoured cushion member (1) having front, side and back surfaces, said cushion member being in front of said frame members, a trim cover (12) covering the front and sides of said cushion member and being partly turned around to lie over part of said back surfaces, a back cover (13) of substantially no stretchability, operatively secured to the edges of said trim cover providing a soft back covering for the cushion assembly, a stretchable support member (2) located between said cushion member and said back cover, said support member and said back cover forming a bag which is adapted to be mounted onto said frame members under tension.

8. A cushion assembly as claimed in claim 7 wherein a stretchable support strip (2″) is associated with and extends across a lower portion of said support member (2) for reinforcing the same.

9. A seat back assembly as claimed in claim 7, wherein said support member has edge portions for being partly turned around said frame member and operatively engaging said trim cover.

* * * * *